United States Patent [19]

Doveri

[11] Patent Number: 4,612,891

[45] Date of Patent: Sep. 23, 1986

[54] FEEDING GOVERNOR OF A DIESEL CYCLE ENGINE IN THE STARTING STAGE

[75] Inventor: Carlo Doveri, Pontedera, Italy

[73] Assignee: Piaggio & C. S.p.A., Genoa, Italy

[21] Appl. No.: 683,690

[22] Filed: Dec. 19, 1984

[30] Foreign Application Priority Data

Dec. 23, 1983 [IT] Italy ..... 24368 A/83

[51] Int. Cl.[4] ..... F02M 39/00

[52] U.S. Cl. ..... 123/373; 123/179 L; 123/365

[58] Field of Search ..... 123/179 L, 373, 365, 123/366

[56] References Cited

U.S. PATENT DOCUMENTS 4,143,634 3/1979 Ritter ..... 123/179 L
4,176,642 12/1979 Shipinski ..... 123/179 L
4,286,558 9/1981 Djordjeuic ..... 123/373
4,355,609 10/1982 Skinner ..... 123/373
4,479,474 10/1984 Djordjeuic ..... 123/179 L

*Primary Examiner*—Carl Stuart Miller
*Attorney, Agent, or Firm*—Cushman, Darby & Cushman

[57] ABSTRACT

An automatic governor device for automatically governing the delivery of an injection pump of a Diesel engine, in particular of the single cylinder type for use in motor vehicles, comprising a centrifugal mass governor with a spring for governing the delivery supplement at the starting stage, a spring for governing the idle rate of the engine, and a spring for governing the rates of higher values. Said device comprises a component capable of a holding the governor in its position of control of the highest delivery of the pump at a starting rate of the engine, higher than the idle rate, and of practically ceasing its influence on the govering action, in particular in the idle rate range, as soon as said starting rate has been reached.

1 Claim, 5 Drawing Figures

FEEDING GOVERNOR OF A DIESEL CYCLE ENGINE IN THE STARTING STAGE

As it is well known, the delivery of the fuel injection pump in a Diesel cycle engine for motor vehicles is generally governed by the driver, with the aid of a suitable automatic governing device as a function of the turning rate of the engine. Such device is normally a centrifugal mass governor with a pre-loaded spring, whose pre-load can be suitably varied on driver's control, and with a slider mechanically linked to the component limiting the useful stroke of injection pump piston.

The primary function of the governor is generally of maintaining the rate of the engine around a determined value with varying loads, such value being selected by the driver by means of an appropriate control lever acting on the governor. On Diesel cycle engines for motor-cars, such function is however limited only to operating ranges around the minimum and maximum rates. The governor has moreover the function of supplying at the moment of, and during the whole stage of starting, a supplement of fuel, in addition to that necessary for having the maximum power, to the purpose of making easier the cold starting of the engine, especially at low temperature.

Normally, the functions mentioned do not interfere with each other; one has i.e. a first starting stage, during which the rate of the engine rises rapidly until it reaches the minimum self-sustaining value, while the delivery of the pump is equally rapidly reduced by the governor from the said maximum value down to the minimum value corresponding to the idle operating of the engine, after which said rate is held nearly constant by the governor, with varying loads, at least until the control lever is kept towards its position of minimum rate. Successively, by moving the control lever towards its position of maximum rate, the governor is allowed to normally intervene as necessary, continuously or after that the rate of the engine has exceeded a certain value, corresponding to positions of control lever more and more shifted towards its position of maximum rate, to the purpose of keeping said rate nearly constant.

However, should it be difficult for the engine to reach the operating temperature at its idle rate during the starting stage, as it can happen with a low environmental temperature, especially when the engine is of the single cylinder type, and has therefore very spaced energy impulses and is moreover more exposed to the cold surrounding environment, so that the lubricating oil is still very viscous and the mechanical resistances are therefore very high, it can happen that the energy supplied by the fuel at the end of starting stage, when the delivery of the pump has already been reduced at its minimum value by the governor, is insufficient for overcoming the energy absorbed by the greater resistance, and it can happen that the engine stops.

A seeming remedy would appear to increase the rate at the end of the starting stage, by means of a greater feed of fuel, so to obtain a greater heat production during the starting time. But when so doing, the result would be obtained of having also an excessive value of the rate at the idle rate at heated engine.

The purpose of the present invention is to overcome the said drawback shown by Diesel cycle engines with a low number of cylinders, in particular by single cylinder engines, especially of the type used on motor-cars and on light motor-cycles. The concept on which the invention is based is of introducing in a governor of normal type a separation threshold between the starting stage and the idle stage, such as to delay the intervention of reduction of pump delivery by the governor, until an adequate rate, and hence an adequate kinetic energy is exceeded, for allowing the idle rate to be stabilized. Such a concept has been realized by the invention in a particular embodiment, by means of the application of a permanent magnet interposed between the governor casing and a component of said governor mechanically connected to the related centrifugal masses, capable of exerting on said component an attractive force counteracting the action of the masses until the minimum self-sustaining rate is reached of the engine in cold conditions.

As the attractive force of the magnet decreases, as it is well known, with an inverse proportionality law with the square of the distance from the element onto which it is exerted, it happens that when said component is separated from the magnet due to the prevailing action of centrifugal masses, such attractive force is practically annihilated, with the consequence that the normal working is restored of the governor at the idle rate at heated engine, notably lower than the rate reached during the starting stage.

The invention is schematically shown in the drawings attached.

Figure 1:
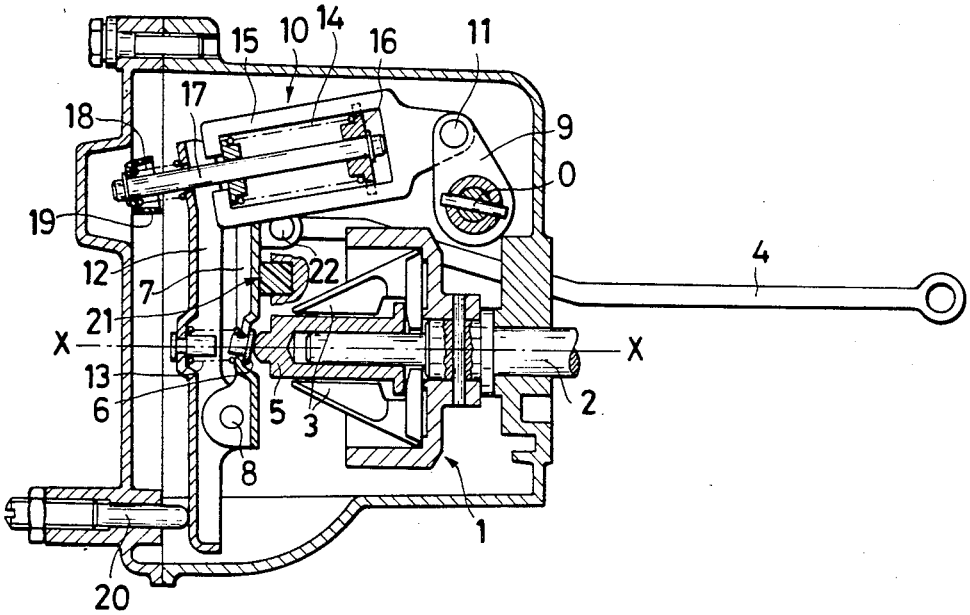
FIG. 1 shows the invention inserted in a normal governor for Diesel cycle engines for motor-cars in the position maintained by it during the starting stage.

The governor device, known by itself, comprises a centrifugal governor 1, driven by the shaft 2, rotating around its own axis x—x at a rate proportional to the rate of the engine, not shown in the Figure, the masses 3 of said governor being kinematically linked to the control rod 4 of the injection pump, it too being not shown in the FIGURE, through the slider 5, which is capable of sliding on the shaft 2 along the axis x—x, the thrust bearing 6 and the lever 7, pivoted onto the fixed pin 8. The action of the masses 3 is counteracted by the lever 9, controllable by the driver, rotatable around the axis outlined as O, by means of a precompressed link 10, hinged on the pivot 11 of lever 9, and fastened to the end of a lever 12, which too is pivoted on the fixed pin 8, and acts in its turn on the said lever 7 through the so-called starting delivery supplementing spring, indicated with the reference number 13.

The pre-compressed link 10 comprises a spring 14 preloaded within a frame 15 through the plate 16 positioned on an end of a rod 17 which can slide inside the frame 15, whose other end is linked to the lever 12, through a so-called idle rate governing spring 18, when this spring is compressed, by a cup 19. A stop 20 limits the stroke of lever 12.

The magnet 21 which characterizes the invention is placed between the casing of the governor and the lever 7.

The governor described works as follows:

When the engine is resting, and during the starting stage, the relative position of the components of the governor is as shown in FIG. 1. The lever 7, pushed by the delivery supplementing spring 13, preloaded by the lever 12, which is in its turn kept in its shoulder position against the stop 20 by the link 10 through the idle rate governing spring 18, such lever 7 being attracted by the magnet 21 nearly to contact it, holds the rod 4 of pump governing in its position of maximum delivery.

As soon as the rate of the engine become greater that the minimum self-sustaining rate under cold conditions, the action of centrifugal masses 3, transmitted to the lever 7, through the slider 5 and the thrust bearing 6 overcomes the antagonist action of the spring 13 and of the magnet 21. The masses 3 are therefore abruptly moved away from the axis x—x of shaft 2, driven by the engine, compressing the delivery supplementing spring 13 to the end of its stroke, and hence moving the lever 7 practically outside the action of the magnet 21, and moving the rod 4 to its position of minimum delivery, under load zero, as shown in FIG. 2.

It must be observed, in particular, that the lever 12 has moved away from the stop 20. From this moment on, the lever 7 and the lever 12 form a single unit swinging around the pin 8 under the action of the centrifugal masses of the governor 1 and of the idle rate governing spring 18, which has much more rigid characteristic than the delivery supplementing spring 13, remained, as previously said, at the end of its stoke.

As however the delivery of the injection pump has been considerably reduced by the governor, as mentioned above, down to the value required by the engine for idle running at its idle rate under warmed-up conditions, controlled by the governor running with the range of elastic characteristic of the spring 18, remarkably lower than that reached during the starting stage, the engine is forced to slow down. As a consequence, the action of the centrifugal masses on the lever 7 decreases, but not to such an extent as to allow the spring 13 to bring it back under the action of the magnet 21, in the position it had during the starting stage.

Figure 2:
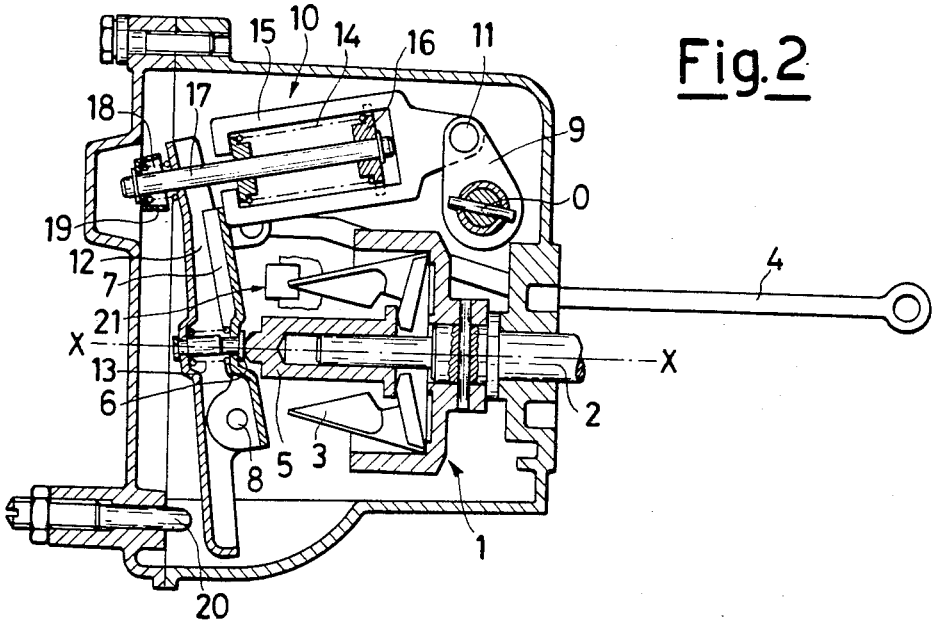
FIGS. 2, 3, 4 and 5 show the same governor respectively in its positions corresponding to the stages of idle rate, partial load, maximum load and maximum rate.

The single unit formed by the levers 7 and 12 finds therefore a correspondent position of equilibrium, as shown in FIG. 2. Subsequent increases of resistance against the rotation of the engine, tending to further decrease the rate are coped with by means of a further reduction of the action of centrifugal masses, and hence of a relief of the spring 18 and of a resulting shift of the lever 7 and of the rod 4 towards positions of greater delivery of the pump.

The behaviour of the governor in correspondence of the movement of the control lever 9 is at all normal.

Figure 3:
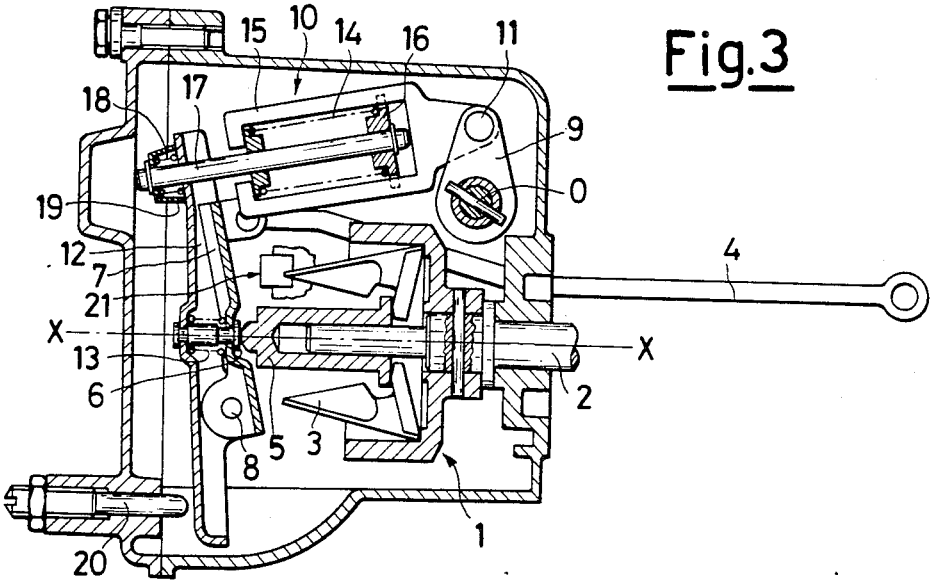

When the lever of control 9 is displaced by the driver in the direction contrary to the action of the minimum governing spring, this latter is compressed until the cup 19 comes into shoulder position against the lever 12, as it is shown in FIG. 3. The delivery of the pump and the rate of the engine are slightly increased. A further displacement of the lever 9, while the rate of the engine remains under a certain value, causes, through the precompressed link 10, a proportional displacement of the pump delivery control rod 4, notwithstanding the opposition by the centrifugal masses, towards higher displacements and hence a higher rate of the engine. When the engine rate exceeds a predetermined value in correspondance of any position of lever 9, the action of centrifugal masses succeeds in overcoming the preload of the spring 14 of precompressed link 10, and the whole device resumes its function of automatic governing of the speeds, controlled by the elastic characteristics of the spring 14.

Figure 4:
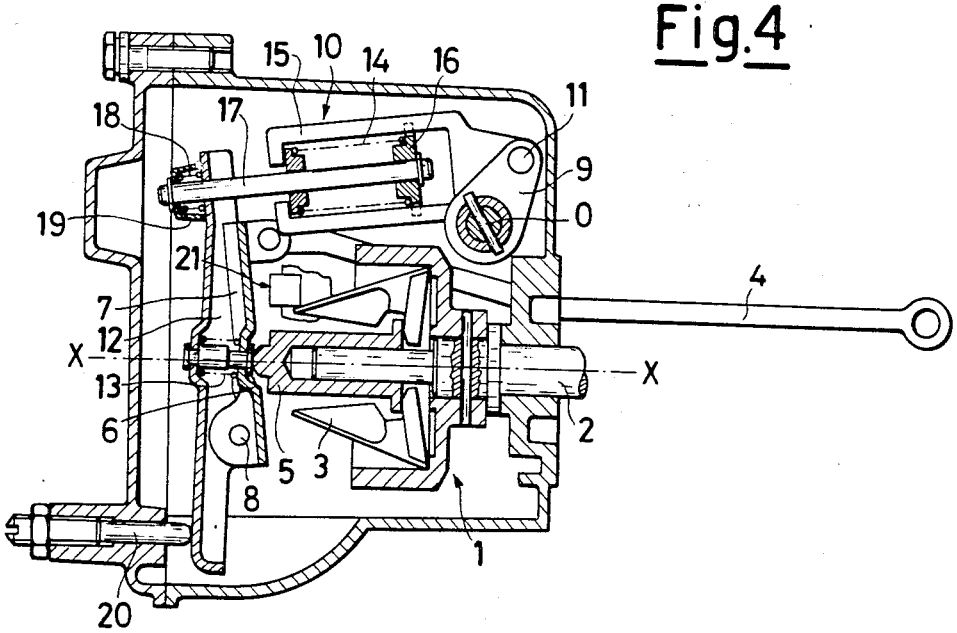

The relative position of the components of the governor device in this stage is shown in FIG. 3, or in FIG. 4, in the case in which the lever 9 is in its maximum load position, and the rate of the engine corresponds to that of maximum power.

The stop 20 limits the shift of the lever 7 at the position of maximum delivery of the pump at full load.

Figure 5:
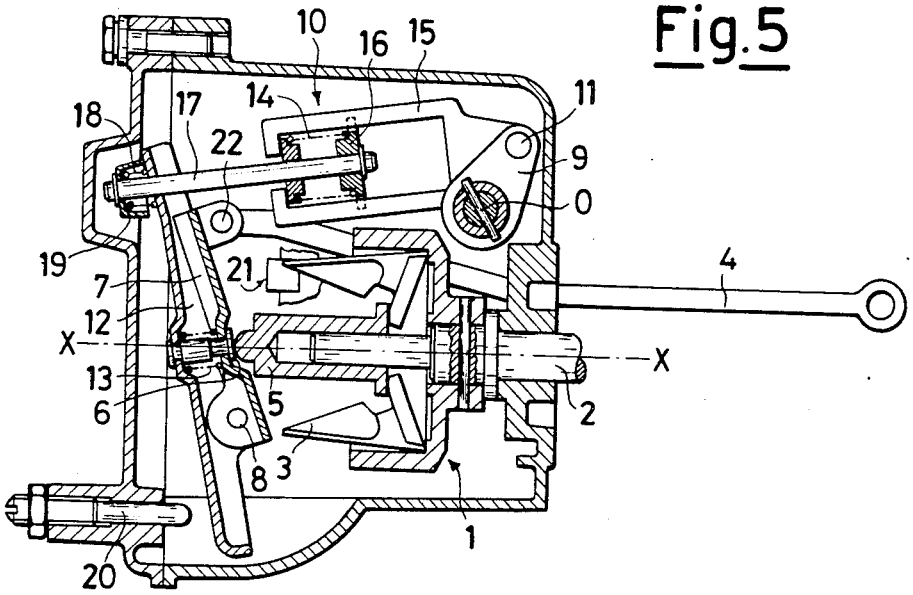

If the rate increases, the masses 3 are further opened, causing the rod 4 to be shifted towards positions of lower delivery, as shown in FIG. 5.

It is understood that the invention comprises the introduction in the governor of a Diesel engine, of any means having a comparable action to that of a magnet as described hereinbefore.

I claim:

1. An automatic governor for a fuel injector pump of an internal combustion engine comprising a housing, a slider control member moved by a centrifugal weight arrangement, a lever arrangement having a pivot point fixed to the housing, the lever arrangement comprising a first lever pivotally connected to a control rod of the injector pump, a second lever pivotably connected to the first lever at said pivot point, the second lever being spring biased to the first lever by a first spring member, the second lever further being biased by a second and third spring, the first lever capable of being moved by the slider control member at a predetermined engine speed, the first lever having a rest position during starting of the engine whereby the fuel injection pump delivers a maximum fuel output, a magnet fixed to said housing capable of maintaining the first lever in the rest position to ensure maximum fuel output during starting, the governor being arranged such that when the engine starts the first lever and control rod actuate the fuel pump to reduce delivery of fuel corresponding to an idle speed.

* * * * *